US006708843B2

(12) United States Patent
Santangini et al.

(10) Patent No.: US 6,708,843 B2
(45) Date of Patent: Mar. 23, 2004

(54) PAINTBALL CONTAINER TUBE LOADING STAND

(76) Inventors: Gennaro L. Santangini, 6 Trafalger Ct., Sewell, NJ (US) 08080; Paul D. Santangini, 206 Teal Rd., Mullica Hill, NJ (US) 08062

( * ) Notice: Subject to any disclaimer, the term of this patent is extended or adjusted under 35 U.S.C. 154(b) by 141 days.

(21) Appl. No.: 10/157,433

(22) Filed: May 29, 2002

(65) Prior Publication Data

US 2003/0222095 A1 Dec. 4, 2003

(51) Int. Cl.[7] ..... B23Q 7/00
(52) U.S. Cl. ..... 221/174; 124/50
(58) Field of Search ..... 221/174, 289, 221/185; 124/50, 56, 73, 76

(56) References Cited

U.S. PATENT DOCUMENTS 6,502,567 B1 * 1/2003 Christopher et al. ..... 124/51.1
6,508,384 B1 * 1/2003 Tien et al. ..... 221/289

* cited by examiner

*Primary Examiner*—Kenneth W. Noland
(74) *Attorney, Agent, or Firm*—Marvin C. Gaer

(57) ABSTRACT

A portable paintball container tube loading stand is disclosed, which facilitates the loading of paintballs into paintball container tubes. This support stand comprises a vertical free standing frame which supports a shelf in which there are apertures for vertically inserting paintball container tubes. A hopper, with an open top and bottom, is rotatably attached to this shelf and can be positioned atop this shelf over the inserted tubes. The walls of this hopper are tapered downward towards the open ends of the inserted paintball tubes. These open ends are essentially flush with the top surface of the shelf. Paintballs are delivered into the upper wide mouth of the hopper which directs these paintballs downward into the container tubes. After the tubes have been loaded, the hopper is rotated to the open position to allow the loaded tubes to be removed.

8 Claims, 5 Drawing Sheets

PAINTBALL CONTAINER TUBE LOADING STAND

FIELD OF THE INVENTION

The present invention concerns the apparatus involved in playing the sport of paintball warfare and discloses a loading stand that facilitates the loading of paintballs into a paintball container tube which in turn is then used to load paintball gun magazines.

BACKGROUND OF THE INVENTION

The sport of paintball warfare has become a popular pastime and a military training exercise. The sport employs the use of hand held paintball air compression guns which shoot out small approximately .68 caliber diameter paintballs. These paintballs are semi-hard, hollow, plastic balls containing various colored dyes, which leave a colored mark on the objects they strike. These paintballs are contained in paintball ammunition magazines that are attached to and feed these paintballs into the guns. These magazines must be reloaded or refilled from time to time from paintball container tubes, "tubes" or "tube" for short, which are carried into the playing area. These tubes themselves must be reloaded from bulk paintball stock supplies by pouring these paintballs into the tubes or by hand delivering the paintballs to the tubes. At the present time, the procedure for reloading the tubes has proven to be an awkward process often leading to the destruction, damaging or soiling of the paintballs being transferred to the tubes, thus rendering the paintballs too defective for use in the guns. Various haphazard methods have been applied to overcome this problem, but none has proven to be sufficiently effective or easy to use in order to meet with wide acceptance.

SUMMARY OF THE INVENTION

The invention described here provides a solution to the problems met in reloading these tubes with paintballs by disclosing a practical, inexpensive, portable, easy to use loading stand apparatus to facilitate the rapid reloading of these tubes. This apparatus comprises a stand which supports two parallel, horizontal shelves, separated by a few inches. These shelves are provided with circular vertically aligned apertures into which the tubes to be loaded are inserted and held steady in fixed, vertical positions, the top of each of the tubes being essentially flush with the top surface of the top shelf. Attached to the top shelf, by a pivoting hinge, is a wide mouthed hopper, open at the top and bottom. When this hopper has been rotated over and onto the top shelf, the paintballs can be poured into the hopper which funnels these paintballs into the top open ends of the tubes until they are full. To remove the loaded tubes, the hopper is rotated off the top shelf freeing the tubes.

It is thus an object of this invention to provide a container tube support means to facilitate the loading of paintballs into a container tube.

It is a further object of this invention to provide a container tube support means for loading paintballs into a container tube which is easy to use, reliable and portable.

It is a further object of this invention to provide a loading stand for loading paintballs into a container tube which is inexpensive to manufacture.

These and other objects will be apparent to those skilled in the art.

BRIEF DESCRIPTION OF THE DRAWINGS

The more specific object features and advantages of this invention will be more readily apparent from the following description wherein reference is made to the accompanying drawings illustrating a preferred embodiment of the invention.

In the drawings.

DETAILED DESCRIPTION OF THE DRAWINGS

A preferred embodiment of the paintball container tube loading stand, in which one tube or two tubes simultaneously can be loaded, is described and exemplifies embodiments in which one tube or two or more tubes can be loaded simultaneouly.

Figure 9:
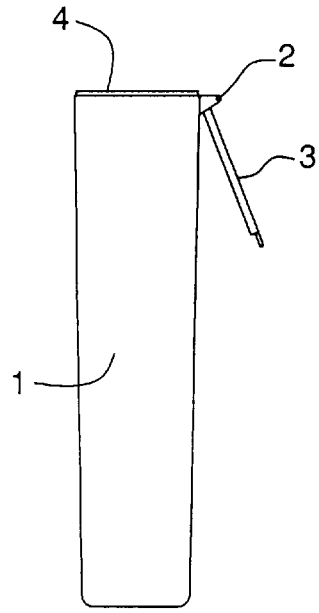
FIG. 9 is a side elevation view of a paintball container tube with its hinged cover in an open position.

In FIG. 9 a standard paintball container tube is illustrated. A standard tube is a circular cylinder 1, slightly less than 12 inches long, having one open circular end 4, between 2 and 3 inches in diameter. This end can be sealed with a lid 3 which is attached to the rim of the open end 4 by a short flexible hinge 2. The lid 3 is opened to allow the tube 1 to be loaded with paintballs and when the tube 1 is used to load the paintballs into the magazine of the paintball gun. The lid 3 is usually closed when the tube 1 is being carried.

Different views of a paintball container tube loading stand, "loading stand" for short, are presented in FIGS. 1 through 8 in the preferred embodiment in which one tube or two tubes simultaneously can be filled.

Referring to FIGS. 1, 2, 4, 5, 7 and 8, a loading stand is shown, which comprises a flat rectangular strip or plate which is bent to define three flat rectangular planes which, when viewed edge on, forms an inverted, squared off "U". The full plate width 60 is about three container tube lengths, which therefore is the length of the upper, horizontal, middle section or upper shelf 21. This upper shelf 21 meets each of the two vertical side planes 20 and 22 at a right angle. This structure thus constitutes an essentially vertical, free standing frame supporting a horizontal upper shelf. The upper shelf 21 width is approximately two tube diameters which is also the distance separating the outer surfaces of the two vertical sides 20 and 22. The vertical side planes 20 and 22 are of equal height which should each be somewhat longer than the length of a tube. The top and bottom edges of the vertical sides 20 and 22 is the same as the length of the upper shelf 21. Attached to and across the inward facing surfaces of the vertical sides 20 and 22 and parallel to the upper shelf 21, approximately half-way down these vertical sides, is a flat thin shelf 29, the lower shelf. This lower shelf 29 has approximately the same dimensions as the downward facing surface of the upper shelf 21. This lower shelf 29 serves to strengthen the structural form and integrity of the loading stand.

Referring again to FIGS. 2, 4, 5, 6 and 7, there are indicated two circular apertures 27 and 37 in the upper shelf 21 symmetrically spaced with respect to the open ends of this shelf. The diameters of these apertures 27 and 37 are just large enough to allow the free insertion of a tube 1 into each aperture. Each aperture 27 and 37 is positioned close enough to the vertical side 20 so that, when tubes are inserted into these apertures, the hinge 2 of each tube 1 will extend across the outer top edge of the surface of the vertical side 20. This will allow this hinge 2 to hold the lid 3 of the tube over the top edge of side 20, while holding the top circular rim or edge 4 of each tube almost flush with the upper surface of the top shelf 21.

Figure 1:
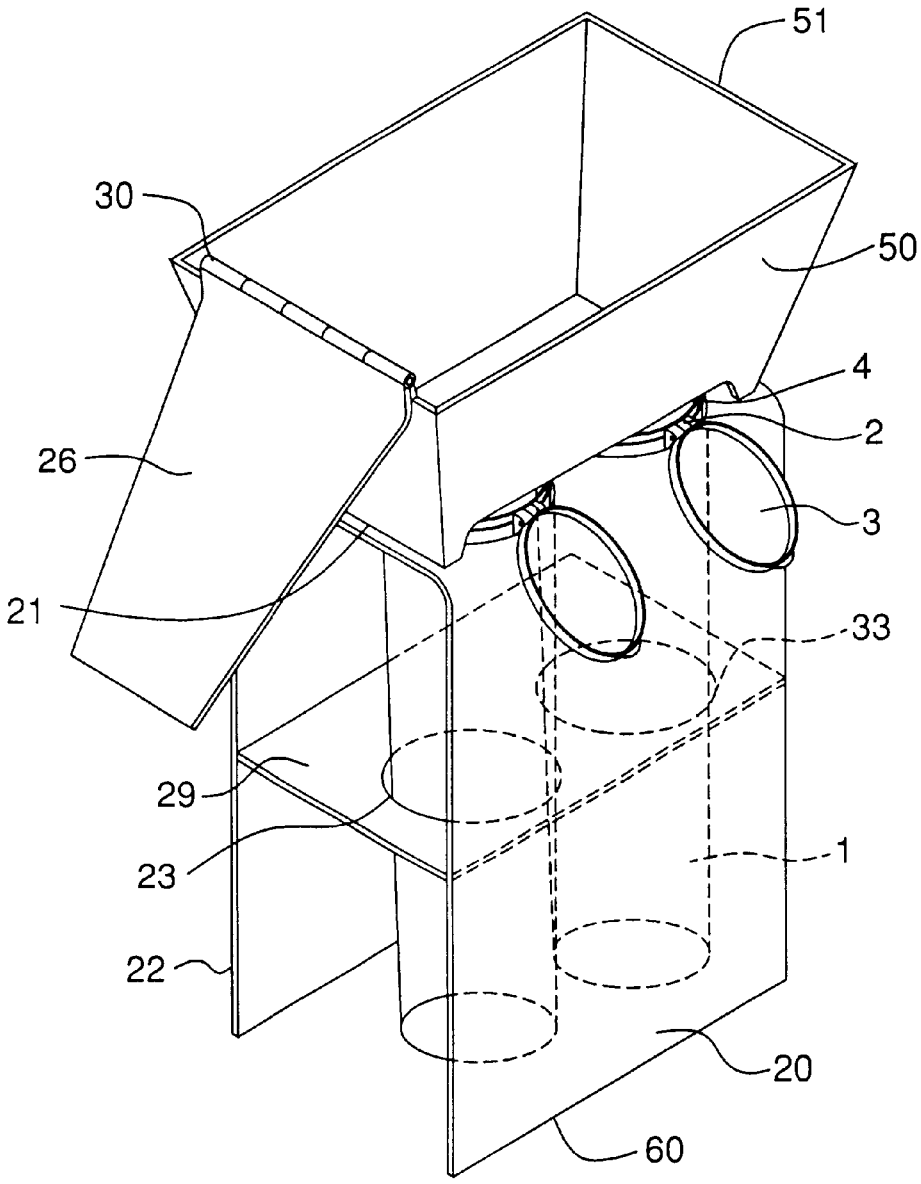
FIG. 1 is an upper perspective view of a two paintball container tube loading stand, with the hopper in the loading position, the hopper shield in the open position and two tubes in place to be loaded with paintballs.
Figure 2:
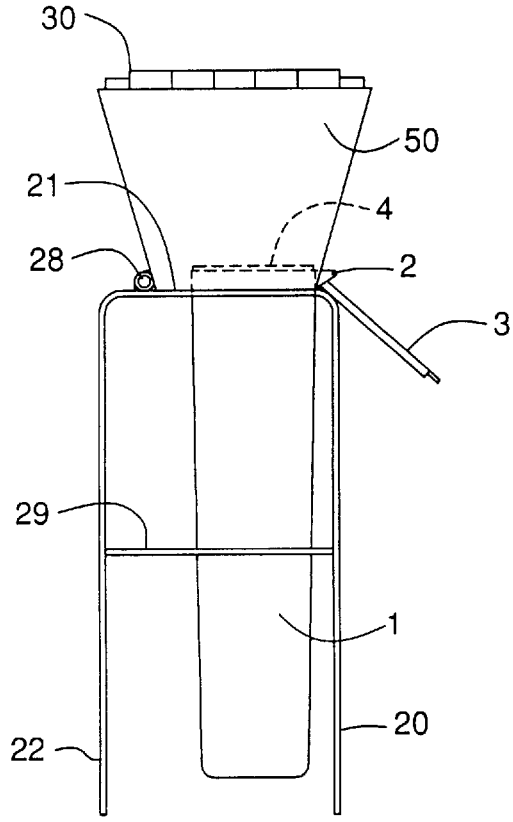
FIG. 2 is a left side elevation view, looking through the loading stand, with the hopper in the loading position, with the hopper shield rotated into the hopper, and one tube in place to be loaded.
Figure 3:
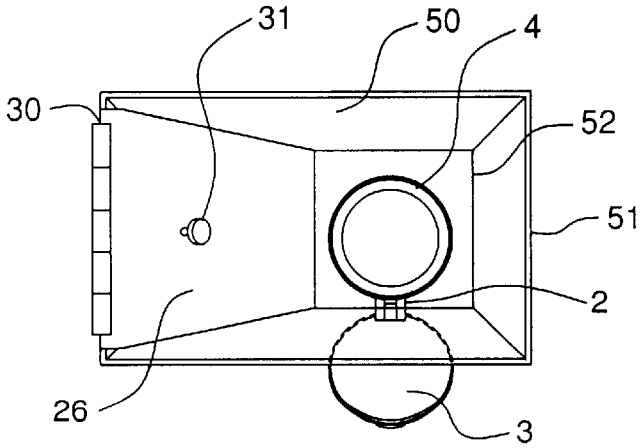
FIG. 3 is a top plan view of the loading stand, looking downward into the hopper in the loading position, with the hopper shield covering an unused tube aperture, and with one tube placed in an aperture to be loaded.
Figure 4:
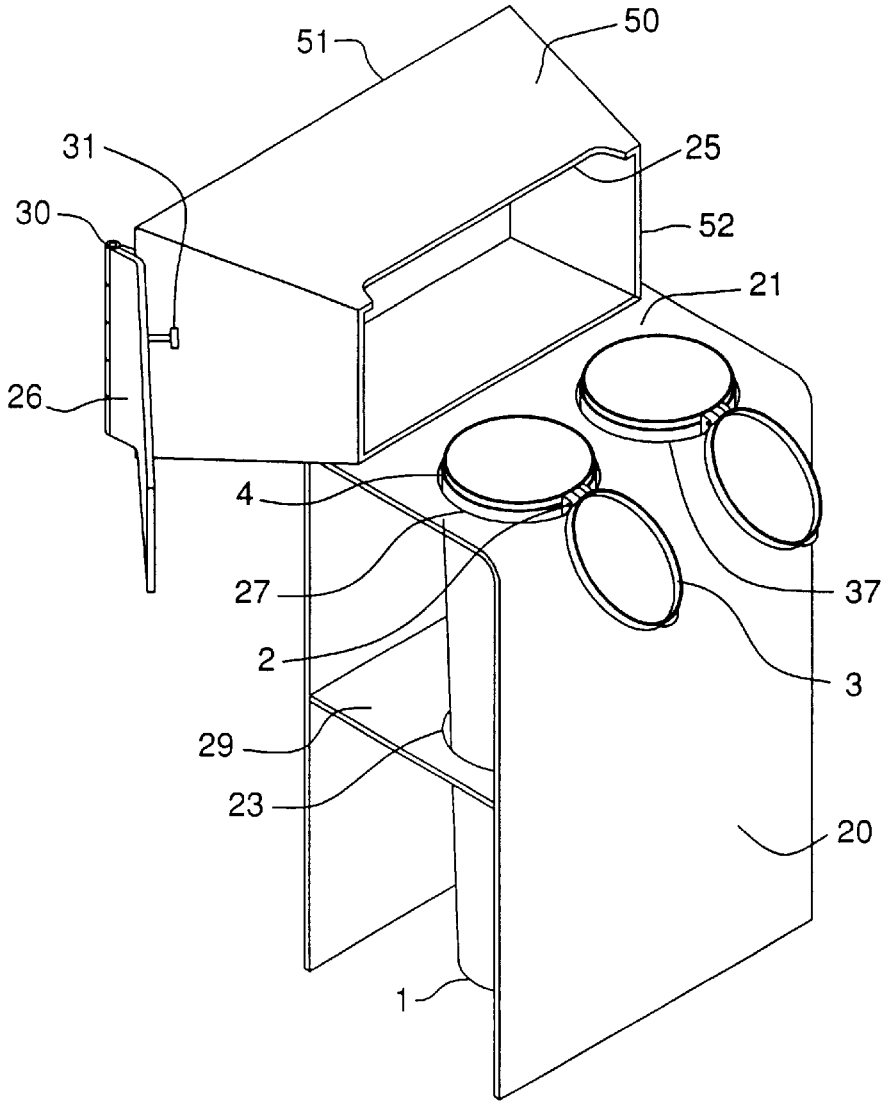
FIG. 4 is an upper perspective view of the loading stand, with the hopper and the hopper shield rotated to the open position, and with two tubes in place to be loaded.
Figure 5:
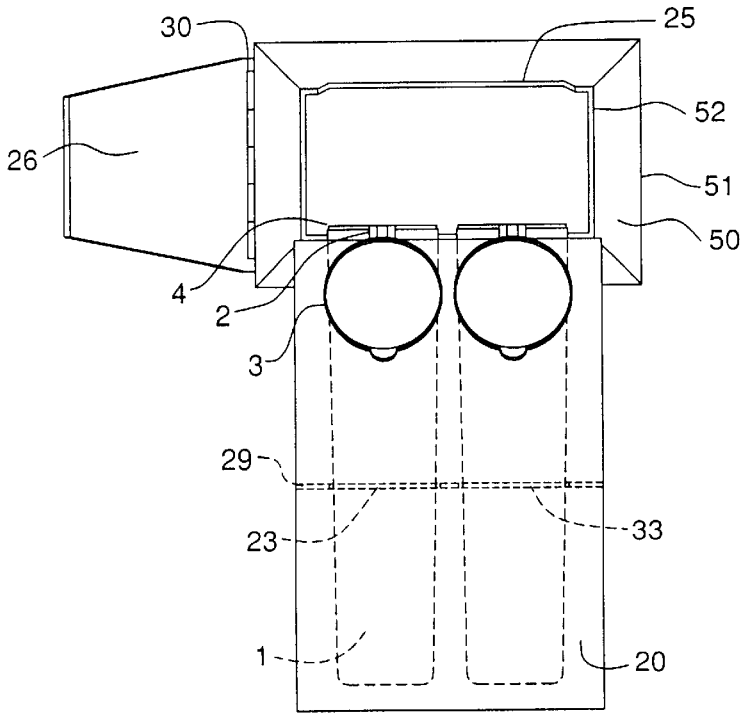
FIG. 5 is a front elevation view of the loading stand, with the hopper and hopper shield rotated to the open position, and with two tubes in place to be loaded.
Figure 6:
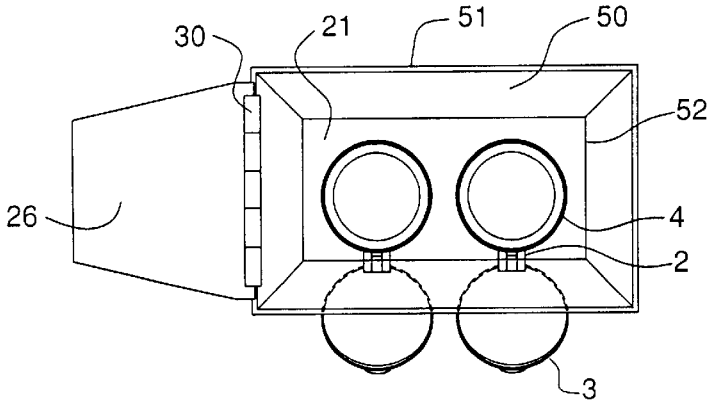
FIG. 6 is a top plan view of the loading stand, looking downward into the hopper, which is in the loading position with the hopper shield open, to allow the simultaneous loading of the two tubes in place.
Figure 7:
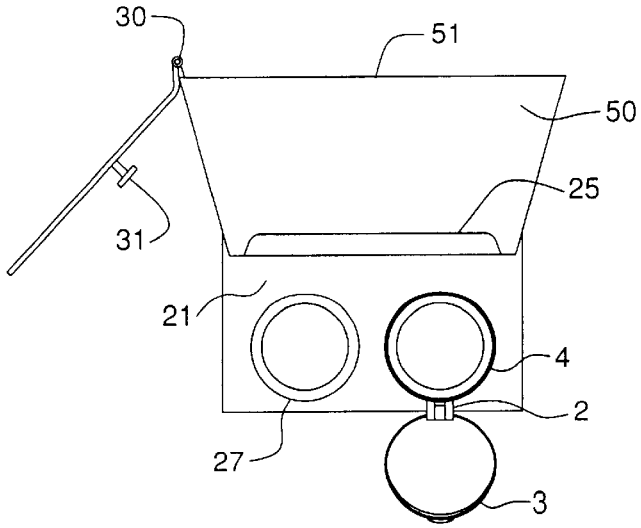
FIG. 7 is a top plan view of the loading stand, looking downward onto the two tube aperture plate, which holds one tube to be loaded and has one aperture empty, and with the hopper and hopper shield rotated to the open or non-loading position.
Figure 8:
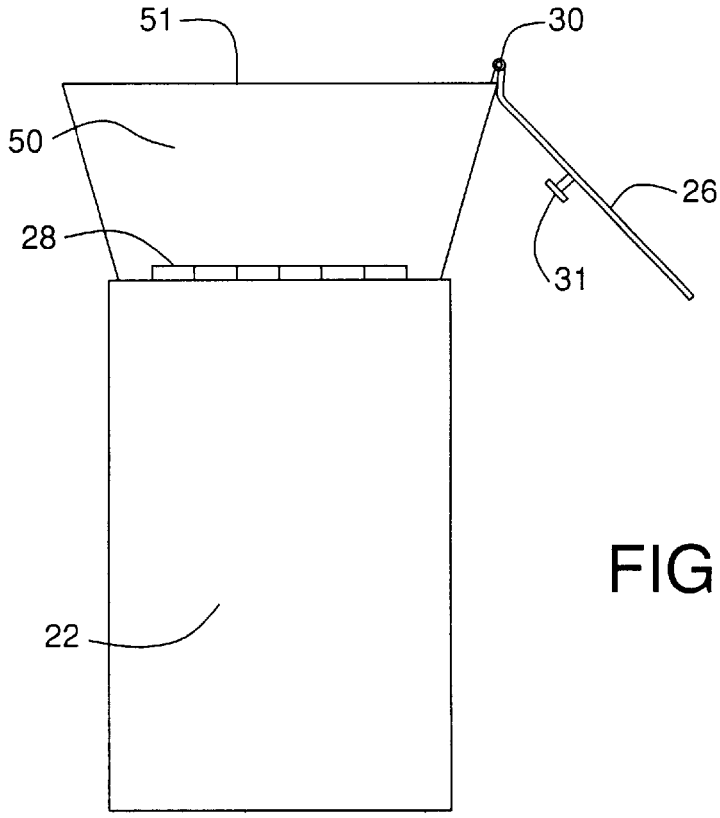
FIG. 8 is a rear elevation view of the loading stand with the hopper in a loading position and the hopper shield in the open position.

Concentric with each of the circular apertures 27 and 37 in the upper shelf 21, are circular apertures 23 and 33 in the lower shelf 29, as shown in FIGS. 1, 4, and 5. The circular apertures 23 and 33 are concentrically aligned with the circular apertures 27 and 37, respectively, along a vertical line through the centers of these apertures. Thus, when the tubes 1 are inserted into the loading stand through these apertures, these apertures will serve to hold these tubes vertically positioned while they are being loaded with paintballs.

Referring again to the Figures, a wide mouthed paintball receiving hopper 50 is shown attached to the upper shelf 21 of the loading stand by a pivoting hinge 28 set in place near the upper edge of the vertical side 22. The hinge 28 also attaches to the hopper 50 along its bottom edge 52, refer in particular to FIGS. 2, 4 and 8.

The top open receiving end of the hopper 50, defined by the edge 51, is of slightly greater area, but the same shape as the upper shelf 21. The walls of the hopper are tapered to narrow downward to form a rectangular delivery opening defined by the edge 52. This delivery opening is large enough to surround the apertures containing the open ends 4 of the tubes to be loaded in the upper shelf 21, but edge 52 of the hopper stays within the area of the upper surface of the upper shelf when the hopper is in the loading position, see FIG. 6. In order to insert the tubes 1 into the loading stand through the apertures 27 and 37, or remove the tubes when they have been loaded, the hopper 50 is rotated about the hinge 28, off the upper shelf 21, to an open position, the first position, see FIGS. 4, 5 and 7. After the tubes 1 have been inserted into the apertures 27 and 37, the hopper 50 is rotated to the upright or closed position, the second position, refer to FIGS. 1, 2, 6 and 8. An indentation 25, along the bottom edge of the hopper 50 which meets the top edge of the vertical side 20 of the loading stand, opposite the lower hinged edge of the hopper, is provided to accommodate the hinges 2 on the tubes which hold the lids 3 of the tubes extended outward from the loading stand, see FIGS. 1, 2, 4, 5, 6 and 7.

The hopper 50 is approximately a hand's width in height when the hopper is in the vertical or closed filling position. The walls of the hopper are tapered in the downward direction, like a funnel, in order to direct the paintballs into the open ends 4 of the tubes 1, when they are being loaded via the hopper.

The hopper 50 is also provided with a tapered aperture shield 26, which is attached to the hopper by a pivoting hinge 30 fixed to the hopper along the upper short side of edge 51. This is the side oriented at a right angle to the lower hinged edge of the hopper and is the short edge nearest the aperture 27 in the upper shelf 21, refer to FIGS. 1 to 8. This aperture shield is left in the open or outward position when both apertures 27 and 37 are being used for filling tubes simultaneously or when the hopper is in an open position as in FIGS. 1, 4, 5, 6, 7 and 8. If only a single tube is being loaded, the aperture shield is rotated, about the hinge 30, inward to close off the unused aperture 27 and to guide the paintballs into the tube which has been inserted into the aperture 37 as in FIGS. 2 and 3. The aperture shield 26 is tapered forward to conform to the downward taper of the hopper 50 and it is bent outward slightly to further conform to the geometry of the hopper. The aperture shield 26 is further provided with a knob 31 in its upper surface to facilitate lifting the aperture shield into and out of the hopper, see FIGS. 3, 4, 7 and 8.

It is anticipated that the loading stand, including the hopper, in the embodiment as described here, would be constructed primarily out of a strong, lightweight, flexible material such as quarter inch thick bendable plastic, with plastic or metal hinges and clips attached where necessary.

It will be understood that the above description of the present invention is susceptible to various modifications, changes and adaptations without departing from the spirit and scope of the present invention, and the same are to be comprehended within the meanings and range of the appended claims.

What is claimed is:

1. A paintball container tube loading stand comprising a vertically oriented, free standing, rigid frame which supports a flat, externally accessible, horizontal shelf at a height greater than the length of a paintball container tube, said horizontal shelf also provided with at least one aperture, said aperture or apertures dimensioned to allow the vertical downward insertion of a paintball container tube far enough so that the top open end of said paintball container tube is almost flush with the upper surface of said shelf, said shelf also provided with a hinge means to which is rotatably attached a paintball receiving, funnel shaped hopper, which can be rotated to a first or open position, exposing said apertures in said shelf, to allow the insertion of said paintball container tubes vertically into said apertures on said shelf, said hopper having an open top and bottom dimensioned to fit completely over all of said apertures in said shelf, said hopper also having a second or closed position into which it can be rotated upon said shelf, so as to receive paintballs through its top opening, said hopper having walls tapered downward and inward in order to guide said paintballs into said container tubes inserted into said apertures, said hopper also being rotatable back into said first or open position to allow the removal of said container tubes after they have been loaded.

2. The paintball container tube loading stand of claim 1, further being provided with a second lower horizontal flat shelf in parallel relation to said first horizontal shelf, said second shelf being provided with the same number and same type of apertures as said first shelf, said apertures to be in vertical alignment with said apertures in said first shelf, said apertures to receive said tubes inserted through said first shelf apertures to facilitate said tubes vertical alignment.

3. The paintball container tube loading stand of claim 1, wherein said hopper is further provided with a shield means to close off unoccupied apertures in said first shelf, in order to guide paintballs into said container tubes which have been inserted into said apertures in said first shelf.

4. A paintball container tube loading stand that can accommodate the loading of two standard, circular cylindrical, lidded, paintball container tubes simultaneously, said loading stand comprising two parallel, vertical, congruent, rectangular sides whose heights are greater than the length of a paintball container tube, each of said vertical sides connected to and supporting, at its top edge, the edge of a horizontal, flat, rectangular, upper shelf, said three surfaces forming an inverted, squared off "U" in edge-on cross section, said shelf being at least three tube diameters in length and approximately two tube diameters in width, said shelf further having two circular apertures through its surface, aligned parallel to the long edge of said shelf, each of said circular apertures being of sufficient diameter to allow the complete vertical insertion and suspension of said tube with the open end of said tube essentially flush with the upper surface of said shelf, also along one upper edge of one of said vertical sides is affixed a hinge means to which is rotatably attached the bottom edge of one side of a four sided hopper having an open top and bottom which are of sufficient size to match the upper surface area of said shelf, the side walls of said hopper being approximately four inches high, said hopper being rotatable into two positions, a first position in which it is rotated to one side of said shelf exposing the top surface of said shelf to allow the insertion of said tubes for loading, said hopper having a second position in which it is rotated to stand upon said upper surface of said shelf to receive the paintballs through its top opening and to guide said paintballs into said open ends of said tubes, said hopper then being rotatable back to said first position to allow the removal of said filled tubes, said hopper further having the free bottom edge, opposite its hinged edge, provided with a narrow, approximately rectangular indentation to allow the hinged lids of said tubes to extend outward over a vertical side, while said tubes are being loaded.

5. The paint ball container tube loading stand of claim 4, further comprising a second horizontal shelf of approximately the same dimensions of said first, upper shelf, said second shelf being attached to the opposite inner surfaces of said vertical sides of said loading stand about halfway down said sides, said shelf being in parallel relation to said first shelf, said second shelf providing extra structural strength to said loading stand, said second shelf further being provided with circular apertures, of the same size as those in said first shelf and in vertical concentric alignment with said apertures in said first shelf, in order to receive the insertion of said paintball container tubes.

6. The paintball container tube loading stand of claim 4, in which said hopper is constructed with side walls which are tapered downward in order that its upper rectangular opening is somewhat larger than its lower rectangular opening, said lower opening being just large enough to enclose said two circular apertures in said horizontal upper shelf when said hopper is rotated to said second, closed position.

7. The paintball container tube loading stand of claim 6, wherein said hopper is further provided with a pivoting hinge means across one top edge which is oriented at a right angle to said lower hinged edge, said top hinge having rotatably attached to it a tapered aperture shield that can be rotated diagonally downward to a closed position into the hopper to close off an empty aperture in said upper shelf if only one paintball tube has been inserted for loading, said tapered shield is shaped to conform to said tapered walls of said hopper in order to guide said paintballs towards said inserted tube, said tapered shield also being rotatable to an open position outside said hopper when two tubes are being loaded simultaneously in said loading stand.

8. The paintball container tube loading stand of claim 4, wherein said two vertical sides and top shelf are formed by bending a single rectangular sheet of semi-pliable construction material of proper length and width, to satisfy the dimensions of said loading stand, into two parallel, vertical sides with a narrower, intermediate rectangular portion connected, at right angles to each of said vertical sides, along parallel lines meeting the opposite sides of said intermediate rectangular portion at right angles, the finished structure having the edge-on cross section of an inverted "U", with the center section forming said top horizontal shelf.

* * * * *